US005549203A

United States Patent [19]

Weisburn et al.

[11] Patent Number: 5,549,203

[45] Date of Patent: Aug. 27, 1996

[54] CONTAINER FOR VIDEO GAME AND BOOKLET

[75] Inventors: James T. Weisburn, Massillon; Christopher G. Gallagher, Akron; Ronald K. Burdett, Strasburg, all of Ohio

[73] Assignee: Alpha Enterprises, Inc., North Canton, Ohio

[21] Appl. No.: 368,662

[22] Filed: Jan. 4, 1995

[51] Int. Cl.[6] ..... B65D 73/00

[52] U.S. Cl. ..... 206/472; 206/473; 281/27.1; 402/68; 402/60

[58] Field of Search ..... 206/232, 472, 206/473; 402/14, 15, 17, 18, 60, 63, 68; 281/27.1, 28

[56] References Cited

U.S. PATENT DOCUMENTS

| | | | |
|---|---|---|---|
| 2,363,848 | 11/1944 | Emmer | 281/27.1 |
| 3,262,454 | 7/1966 | Shillinger | 206/472 |
| 3,757,389 | 9/1973 | Wiland | 402/68 |
| 4,121,892 | 10/1978 | Nes | 402/17 |
| 4,184,594 | 1/1980 | Hehn | 206/387 |
| 4,306,737 | 12/1981 | Errichiello | 206/472 |
| 4,340,316 | 7/1982 | Jahn | 402/68 |
| 4,518,275 | 5/1985 | Rauch, III et al. | 206/472 |
| 4,661,006 | 4/1987 | Stevens | 402/17 |
| 4,761,091 | 8/1988 | Ominato et al. | 402/60 |
| 5,016,752 | 5/1991 | Haugen, Jr. | 206/472 |
| 5,018,896 | 5/1991 | Vanni | 281/27.1 |
| 5,161,907 | 11/1992 | Byrne | 206/472 |

FOREIGN PATENT DOCUMENTS

| | | | |
|---|---|---|---|
| 2500936 | 7/1976 | Germany | 402/68 |
| 9009894 | 9/1990 | WIPO | 402/36 |

*Primary Examiner*—David T. Fidei
*Attorney, Agent, or Firm*—Sand & Sebolt

[57] ABSTRACT

A container for removably storing an article such as a video game, and for securing sheet material to the container, such as the instruction booklet for the video game, to prevent separation of the booklet from the container. The container has a base and a pivotally mounted lid which forms an internal storage compartment with the base. A hinge assembly having an elongated panel and pair of hinge strips pivotally mount the lid on the base. A holder bar is secured to the hinge panel. A pair of flexible straps are provided at the ends of the holder bar and form a pair of loops which extend into the storage compartment of the container when the lid is closed on the base. Other ends of the straps extend through holes formed in the booklet to mount the booklet on the straps, after which the ends are snap-fitted through locking holes formed in the holder bar to permanently secure the booklet on the loops within the container.

7 Claims, 3 Drawing Sheets

CONTAINER FOR VIDEO GAME AND BOOKLET

BACKGROUND OF THE INVENTION

1. Technical Field

The present invention relates to a storage container for an article and for sheet material secured to the container and located within a storage compartment of the container. More particularly, the invention relates to a container for removably storing a video game, and for securing the instruction booklet for the game within the storage compartment of the container to prevent loss of the booklet. Even more particularly, the invention relates to such a container in which a holder for the booklet is formed separately from the container and is mounted on the container when required for securing the booklet to the container.

2. Background Information

Video games have become increasingly popular, both for direct sales to a purchaser or by rental from a rental store, which store usually will rent other types of videos, such as movies and other prerecorded programs. However, one problem that is encountered with the rental of video games is that an instruction booklet or various sheets of material must accompany the game to enable the renter to understand and play the game after taking it home from the rental store. The video game, which is removably mounted in the container for its protection during display, storage and shipment, is almost always returned to the rental store. However, the instruction booklet occasionally will get separated from the container at the renter's home, and is not returned to the rental store with the video game. This requires subsequent replacement of the booklet and/or possible loss of rental of the video game, since if there are no instructions to enable those unfamiliar with the game to play the game, it cannot be rented.

Thus, there is a need for a container for storing video games or similar articles for sale, and primarily for rental, which protects the game during storage and transit. Even more particularly, there is a need for such a container for video games which will secure the instruction booklet or other sheet material usually pertaining to the game, in the storage compartment of the container to prevent it from becoming damaged and lost, yet which will enable the user of the game to review the printed material without removing the same from the container.

SUMMARY OF THE INVENTION

Objectives of the invention include providing a container for storing articles, including sheet material, and in particular, for storing a video game or other prerecorded programs and the instruction booklet or printed sheet material required for playing the game or associated with the prerecorded program.

Another objective of the invention is to provide such a container which can be mass produced relatively inexpensively in a single injection-molding process, with the device for holding the instruction booklet being molded separately in a single injection-molding process and then secured to the container, enabling the container to be used with or without the booklet holder as a feature thereof.

A still further objective of the invention is to provide such a container in which the booklet holder is injection molded as a one-piece member and includes a pair of flexible straps which are secured to the holder at one end and after passing through holes or other mounting devices in the booklet, are snap-fitted into locking engagement with the holder, preventing removal of the booklet from the holder.

A still further objective of the invention is to provide such a container in which the booklet holder can be either snap-mounted and secured to the container by molding mounting posts on the container, or can be mounted by the use of pressure-sensitive adhesives or similar types of attachment means.

A further objective of the invention is to provide such a storage container in which the video game and instruction booklet therefor are secured in a storage compartment upon closure of a container lid into a latched position, without requiring manipulation of the booklet or video game, and in which the game and booklet will remain secure in the container free of movement when the lid is latched in its closed position.

These objectives and advantages are obtained by the container of the present invention which is used for storing an article and sheet material, the general nature of which may be stated as including a housing having a base and a closure lid forming an interior storage compartment for removably storing an article therein; hinge means for hingedly connecting the lid on the base for movement of said lid between open and closed positions; and holder means located within the storage compartment when the lid is in the closed position for permanently securing sheet material within the storage compartment adjacent an article stored therein.

These objectives and advantages are further obtained by a holder for sheet material adapted to be mounted within a container which also holds an article, the general nature of which may be stated as including an elongated holder bar, means for securing said holder bar on the container, and retainer means on the holder bar for retaining sheet material on the holder bar within the storage compartment.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
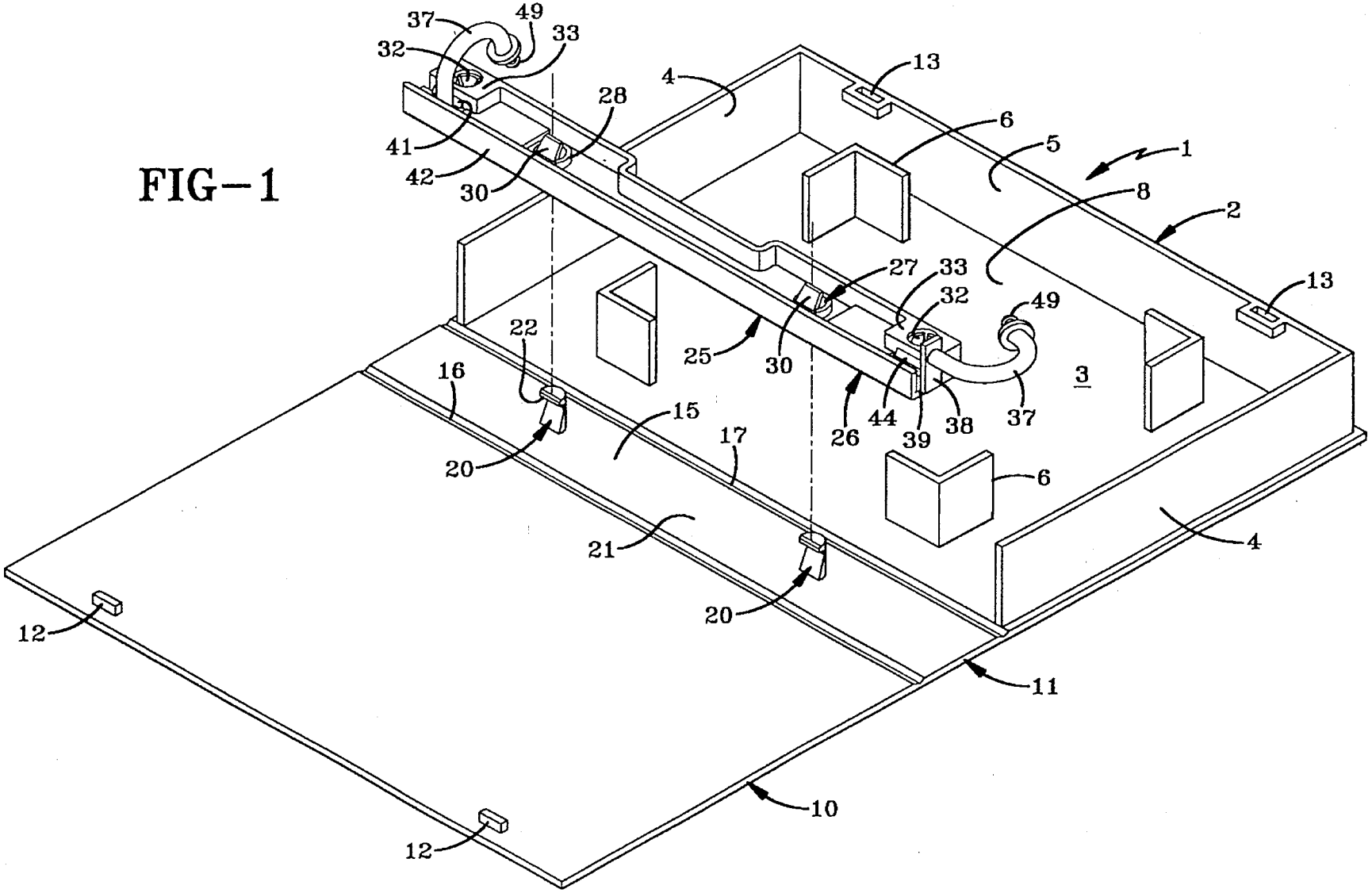
FIG. 1 is an exploded perspective view showing the container of the present invention with the booklet holder prior to securing the holder to the hinge panel of the container.
Figure 2:
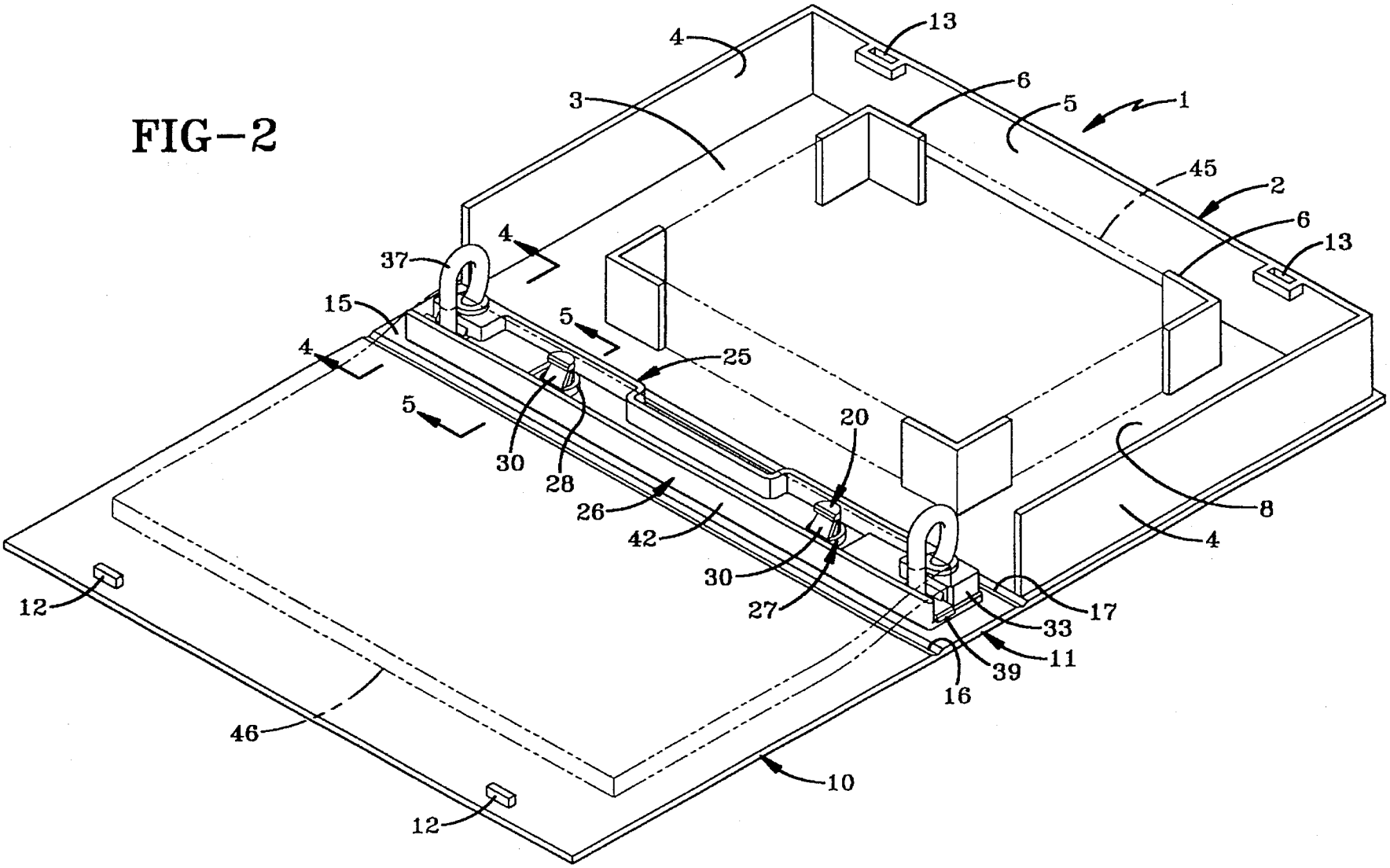
FIG. 2 is a perspective view similar to FIG. 1, showing the booklet holder attached to the container, with a video game being shown in dot-dash lines mounted in the base of the container, and a booklet shown in dot-dash lines secured to the booklet holder.

The container of the present invention is indicated generally at 1, and is shown in assembled position in FIG. 2 and in a partially disassembled position in FIG. 1. Container 1 includes a rectangular housing having a generally box-shaped base, indicated generally at 2, having a flat planar bottom wall 3, a pair of spaced parallel side walls 4, and an end wall 5. A plurality of L-shaped brackets 6 or other types of video game mounting clips, preferably are formed integrally with bottom wall 3 and extend upwardly into the hollow interior or storage compartment 8 formed by base 2.

A lid, indicated generally at 10, is pivotally mounted on base 2 by a double-hinged panel assembly, indicated generally at 11. Lid 10 is a flat rectangular-shaped member, generally complementary to the periphery of the storage compartment defined by walls 4 and 5, and will have a pair of latching projections 12. Projections 12 are adapted to releasably engage aligned latch receptacles 13 formed on end wall 5. Various types of latching mechanisms other than that shown in the drawings can be used to releasably secure lid 10 in a closed position on base 2, without affecting the concept of the invention.

Figure 4:
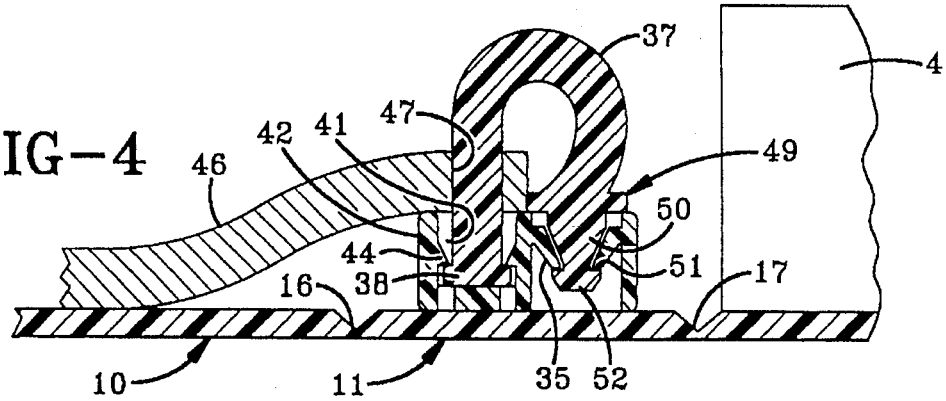
FIG. 4 is an enlarged fragmentary sectional view taken on line 4—4, FIG. 2.

Double-hinged panel assembly 11 includes an elongated rectangular hinge panel 15 connected to lid 10 and base 2 by a pair of hinge strips 16 and 17, respectively (FIGS. 1 and 4). Hinge strips 16 and 17 preferably are living hinges formed as a reduced-thickness area in the plastic material which forms base 2 and lid 10 during the injection molding of container 1.

Base 2 and lid 10 may be of the type shown in U.S. Pat. No. 4,184,594 and may be formed of various types of plastic material, preferably having a rectangular configuration as shown in this patent. It is readily understood that the base and closure lid and double-hinged panel assembly which form container 1 can have other configurations, and that container 1 can be used for other applications than for storing a video game and a booklet holder, as discussed below. Thus, this enables the same mold to be used for forming the container of the present invention that is used for molding a container for storing video cassettes not requiring an instruction booklet.

Figure 5:
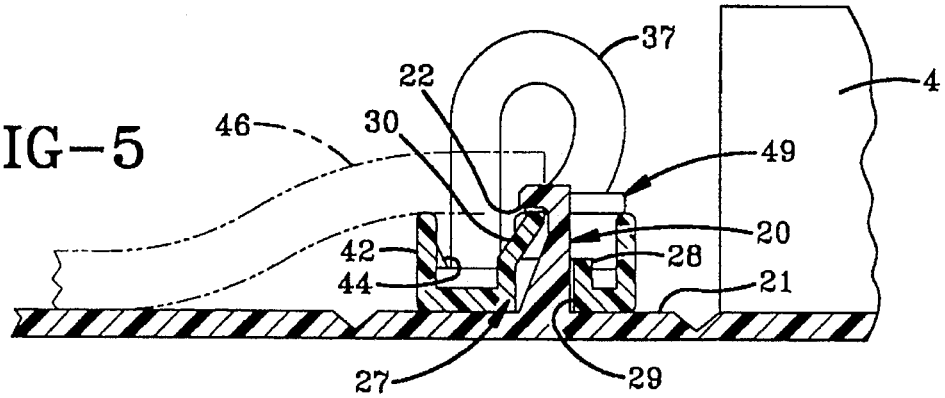
FIG. 5 is an enlarged fragmentary sectional view taken on line 5—5, FIG. 2.

In accordance with one of the features of the invention, a pair of mounting posts, indicated generally at 20, are molded integrally on an inner surface 21 of hinge panel assembly 11, and extend upwardly therefrom. As shown in FIGS. 1 and 5, posts 20 are formed with an undercut shoulder 22, the purpose of which is discussed below.

In further accordance with the invention, a booklet holder, indicated generally at 25, preferably is molded separately from container 1 as a one-piece member for subsequent attachment to container 1. Holder 25 includes an elongated holder bar, indicated generally at 26, which preferably has an elongated, generally rectangular configuration. Bar 26 includes a pair of locking apertures 27, each defined by an arcuate boss 28 which defines an aperture or opening 29. An inclined resilient tab 30 (FIGS. 3 and 5) is formed integrally with boss 28 and projects upwardly at an inclined angle with respect to aperture 29.

As shown in FIGS. 2 and 5, locking bar 26 is snap-fitted into engagement with mounting posts 20, wherein the posts extend through apertures 29 with the free ends of resilient tabs 30 being engaged in undercut shoulders 22 of posts 20 to lockingly secure the holder bar on inner surface 21 of hinge panel 15, as shown in FIGS. 2 and 5. Thus, the cooperation of posts 20 with locking apertures 27 provides for an easy snap-fit mounting of holder bar 26 on container 1.

Holder bar 26 is formed with a pair of spaced holes 32 (FIGS. 3 and 4) in a thickened end portion 33 of the holder bar. A plurality of resilient flaps 35, three of which are shown in FIG. 3, extend into each hole 32, the function of which is discussed further below.

Figure 3:
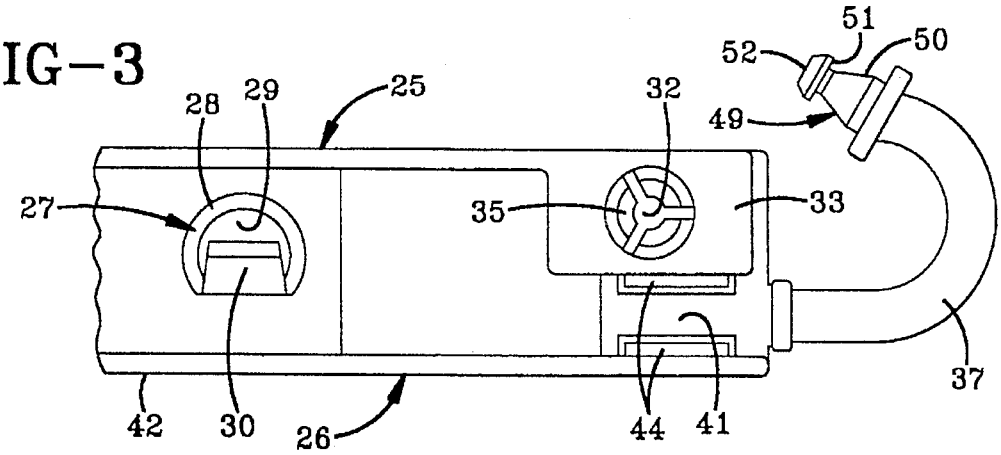
FIG. 3 is an enlarged top plan view of the right-hand end of the booklet holder of FIG. 1.

A pair of flexible straps 37 are formed integrally at the ends of holder bar 26, and are connected thereto by a rectangular base pad 38 and a living hinge strip 39 (FIG. 3). To facilitate the injection molding of booklet holder 25 as a one-piece member, straps 37 will be molded with base pads 38 and integrally connected with holder bar 26 by living hinges 39 and will be in a horizontal outwardly extending position when exiting the mold prior to being folded upwardly into the partially operative position, as shown in FIGS. 1, 2 and 3.

Pads 38 are pivotally moved into a booklet-securing position, as shown in the left-hand end of FIGS. 1 and 2, by pivotally moving base pads 38 into a channel 41 formed between thickened end portions 33 of holder bar 26 and a side wall 42 of the holder bar. A pair of tapered latching projections 44 are formed on thickened end portions 33 and holder bar side wall 42, and extend into channels 41 so as to provide a snap-fit locking engagement with base pads 38, as shown particularly in FIG. 3, to secure straps 37 in their operating position, as shown in FIG. 2.

A usual video game or other type of article, indicated generally at 45 and shown in dot-dash lines in FIG. 2, will be secured within storage compartment 8 of base 2 by L-shaped brackets 6 or other types of retaining means. Sheet material, which in the preferred embodiment is the instruction booklet for use with video game 45, is indicated at 46 and is shown in dot-dash lines in FIG. 2. Either the video game manufacturer or the rental store proprietor will punch or provide a pair of holes 47 in booklet 46. Distal ends 49 of straps 37 (FIG. 4) will be inserted through holes 47, as in a usual loose-leaf, ring binder mounting arrangement. After mounting booklet 46 on straps 37, distal ends 49 are snap-fitted into a permanently secured locked position on holder bar 26 by inserting ends 49 into holes 32, and beyond resilient flaps 35 formed in thickened portions 33 of bar 26, as described above.

As shown in FIG. 4, each distal end 49 of strap 37 has a conical wall portion 50 which terminates in an annular shoulder 51 formed between conical wall 50 and a bulbous end tip 52. As shown in FIG. 4, distal end 49 is snap-fitted through hole 32 and permanently secured therein by the engagement of flexible flaps 35 with annular shoulder 51. Straps 35 form a curved configuration, enabling instruction booklet 46, and in particular, the individual pages thereof (not shown), to be moved to an open, readily readable position, for review when playing the video game, which will have been removed from the container and placed into a VCR or playback mechanism. Furthermore, it is easily seen that upon closure of lid 10, booklet 46 will move easily with the lid and extend over video game 45, which is mounted in base 2, to assist in securing the video game in the base by providing a flexible pad between lid 10 and the video game cartridge.

Figure 6:
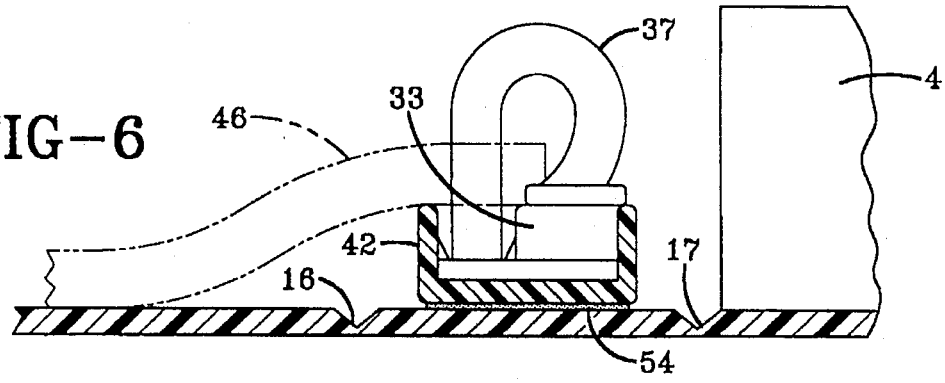
FIG. 6 is an enlarged fragmentary sectional view similar to FIGS. 4 and 5, showing the mounting of the booklet holder by the use of a pressure-sensitive adhesive.

FIG. 6 shows a modification to the mounting of booklet holder 25 on elongated hinge panel 15 by the use of a strip of pressure-sensitive adhesive 54, which eliminates the need of molding posts 20 on container 1. Thus, a usual container 1 used for shipping and the sale and/or rental of other types of articles such as video cassettes, can be easily modified by the video store proprietor for rental applications of video games by purchasing a plurality of the booklet holders 25 and affixing them to elongated hinge panels 15 of usual storage containers by the use of pressure-sensitive adhesive 54 or other types of readily available bonding adhesives. It is readily understood that other types of fasteners can be used by the manufacturer of the container or by the proprietor of a rental store to secure booklet holder 25 to hinge panel 15, avoiding the need of molding posts 20 on container 1 or the use of an adhesive. This enables a usual video cassette container to be easily adapted for use with video games by permanently securing the instruction booklet thereto by separately purchasing a plurality of the holder bars and securing the same to the container.

Accordingly, the improved container, and in particular, the holder bar to be used therewith, provides a device which enables various sheet materials, such as instruction booklets, to be permanently secured to the container which holds an article such as a video game, and which permits the article to be readily removed from the container while retaining the booklet with the container to prevent its accidental loss. Furthermore, container 1 can be mass produced relatively inexpensively by injection molding as a one-piece member, and by separately molding the holder bar as an integral one-piece member in a separate molding operation, and then securing the holder bar to the container by various types of attachment means, as discussed above.

Accordingly, the container is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved container and booklet holder thereof is constructed and used, the characteristics of the construction, and the advantageous, new and useful results obtained; the new and useful structures, devices, elements, arrangements, parts and combinations, are set forth in the appended claims.

We claim:

1. A container for storing an article and sheet material including:

a housing having a base and a closure lid forming an interior storage compartment for removably storing an article therein;

hinge means for hingedly mounting the lid on the base for movement of said lid between open and closed positions, said hinge means including a double hinged panel assembly including an elongated panel and a pair of hinges pivotally connecting the panel to the base and lid;

a pair of mounting posts formed integrally on the elongated panel of the hinge assembly;

a holder bar formed with a pair of apertures for receiving the posts therein for mounting the holder bar on the elongated panel of the hinge assembly;

a pair of spaced flexible straps formed integral with the holder bar and having free ends for inserting through holes formed in the sheet material, said holder bar and flexible straps being a one-piece molded plastic member;

a pair of locking holes formed in the holder bar for lockingly receiving the free ends of the straps therein to form a pair of loops for movably mounting the sheet material on the elongated panel after said free ends have been inserted through the locking holes in the sheet material for permanently securing the sheet material in the container; and lock means engageable with the posts to secure the holder bar on the elongated panel.

2. The container defined in claim 1 in which the mounting posts each have an undercut shoulder; in which a resilient tab is formed on the holder bar adjacent each of the apertures; and in which the said tabs engage the undercut shoulders of the mounting posts to secure said posts within said apertures.

3. The container defined in claim 1 in which the locking holes in the holder bar are defined partially by a plurality of resilient flaps; in which the free ends of the straps are conical and terminate in an annular shoulder; and in which the said annular shoulders are snap-fitted into locking engagement with the resilient flaps to secure the free ends of the straps in the locking holes.

4. The container defined in claim 1 in which each of the flexible straps extends outwardly from a base pad; and in which said base pads are connected to the holder bar by hinges.

5. The container defined in claim 4 in which each of the base pad hinges is a living hinge; in which a pair of channels is formed in the holder bar adjacent the locking holes; and in which the base pads are movable on the hinges into the channels for locating the straps adjacent the locking holes.

6. The container defined in claim 5 in which projections are formed on the holder bar adjacent the channels; and in which the base pads of the strap are secured in the channels by said projections.

7. A container for storing an article and sheet material including:

a housing having a base and a closure lid forming an interior storage compartment for removably storing an article therein;

hinge means for hingedly mounting the lid on the base for movement of said lid between open and closed positions, said hinge means including a double hinged panel assembly including an elongated panel and a pair of hinges pivotally connecting the panel to the base and lid;

holder means located within the storage compartment when the lid is in the closed position for permanently securing sheet material within the storage compartment adjacent an article stored therein; said holder means including an elongated holder bar and pair of spaced flexible straps mounted on the holder bar, said straps being adapted to extend through holes formed in the sheet material for permanently securing said sheet material on the container;

a pair of mounting posts formed on the elongated panel of the hinge assembly and a pair of apertures formed in the holder bar for receiving the posts therein for mounting the holder bar on the elongated panel of the hinge assembly; and said mounting posts each having an undercut shoulder, a resilient tab formed on the holder bar adjacent each of the apertures; and said tabs engaging the undercut shoulders of the mounting posts to secure said posts within said apertures.

* * * * *